US006983605B1

(12) United States Patent
Hook et al.

(10) Patent No.: US 6,983,605 B1
(45) Date of Patent: Jan. 10, 2006

(54) METHODS AND APPARATUS FOR REDUCING GAS TURBINE ENGINE EMISSIONS

(75) Inventors: Richard B. Hook, Sharonville, OH (US); John M. Davidson, Pleasant Plain, OH (US); Eric J. Kress, Loveland, OH (US); Jack W. Smith, Jr., Loveland, OH (US); James W. Stegmaier, West Chester, OH (US); Paul V. Heberling, Lawrenceburg, IN (US); David B. Patterson, Mason, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/545,554

(22) Filed: Apr. 7, 2000

(51) Int. Cl.
*F02C 3/30* (2006.01)

(52) U.S. Cl. ..... 60/775; 60/39.55; 60/737; 60/747

(58) Field of Classification Search ..... 60/39.05, 60/39.55, 737, 747, 775
See application file for complete search history.

(56) References Cited

U.S. PATENT DOCUMENTS

| | | | | |
|---|---|---|---|---|
| 891,715 | A * | 6/1908 | Moss | 60/39.55 |
| 3,313,103 | A * | 4/1967 | Johnson | 60/39.55 |
| 3,461,667 | A * | 8/1969 | Aguet | 60/39.05 |
| 3,747,336 | A * | 7/1973 | Dibelius et al. | 60/39.55 |
| 4,041,699 | A * | 8/1977 | Schelp | 60/39.55 |
| 4,214,435 | A | 7/1980 | Campbell | |
| 4,701,124 | A * | 10/1987 | Maghon et al. | 60/39.55 |
| 4,928,478 | A * | 5/1990 | Maslak | 60/39.05 |
| 4,948,055 | A * | 8/1990 | Belcher et al. | 60/39.55 |
| 5,165,241 | A * | 11/1992 | Joshi et al. | 60/737 |
| 5,259,184 | A * | 11/1993 | Borkowicz et al. | 60/39.55 |
| 5,274,995 | A * | 1/1994 | Horner et al. | 60/39.55 |
| 5,289,685 | A | 3/1994 | Hoffa | |
| 5,307,619 | A * | 5/1994 | McCarty et al. | 60/39.05 |
| 5,351,477 | A * | 10/1994 | Joshi et al. | 60/737 |
| 5,355,670 | A * | 10/1994 | Sciocchetti | 60/39.55 |
| 5,357,741 | A * | 10/1994 | Talabisco et al. | 60/39.05 |
| 5,564,269 | A * | 10/1996 | Briesch | 60/39.55 |
| 5,617,716 | A | 4/1997 | Schreiber et al. | |
| 5,630,319 | A * | 5/1997 | Schilling et al. | 60/747 |
| 5,987,875 | A * | 11/1999 | Hilburn et al. | 60/39.55 |

FOREIGN PATENT DOCUMENTS

| | | |
|---|---|---|
| EP | 0805308 | 11/1997 |
| EP | 0974789 | 1/2000 |

* cited by examiner

*Primary Examiner*—Ted Kim
(74) *Attorney, Agent, or Firm*—Armstrong Teasdale LLP; William Scott Andes

(57) ABSTRACT

A gas turbine engine includes a combustor system including a lean premix combustor and a water delivery system. The combustor is operable with a fuel/air mixture equivalence ratio less than one and the water delivery system is configured to supply at least one of water or steam to the gas turbine engine such that either the water or the steam is injected into the combustor to control emissions generated by the combustor. As a result, nitrous oxide emissions for specified turbine operating power levels are lowered.

19 Claims, 2 Drawing Sheets

METHODS AND APPARATUS FOR REDUCING GAS TURBINE ENGINE EMISSIONS

BACKGROUND OF THE INVENTION

This application relates generally to gas turbine engines and, more particularly, to combustors for gas turbine engine.

Air pollution concerns worldwide have led to stricter emissions standards. These standards regulate the emission of oxides of nitrogen (NOx), unburned hydrocarbons (HC), and carbon monoxide (CO) generated as a result of gas turbine engine operation. In particular, nitrogen oxide is formed within a gas turbine engine as a result of high combustor flame temperatures. Making modifications to a gas turbine engine in an effort to reduce nitrous oxide emissions often has an adverse effect on operating performance levels of the associated gas turbine engine.

In gas turbine engines, nitrous oxide emissions can be reduced by increasing airflow through the gas turbine combustor during operating conditions. Gas turbine engines include preset operating parameters and any such airflow increases are limited by the preset operating parameters including turbine nozzle cooling parameters. As a result, to increase the airflow within the gas turbine combustor, the gas turbine engine and associated components should be modified to operate at new operating parameters.

Because such gas turbine engine modifications are labor-intensive and time-consuming, users are often limited to derating the operating power capability of the gas turbine engine and prevented from operating the gas turbine engine at full capacity. Such derates do not limit an amount of nitrous oxide formed as the engine operates at full capacity, but instead limit the operating capacity of the gas turbine engine.

BRIEF SUMMARY OF THE INVENTION

In an exemplary embodiment, a gas turbine engine includes a combustor system to reduce an amount of nitrous oxide emissions formed by the gas turbine engine. The combustor system includes a combustor and a fuel and water delivery system. The combustor is a lean premix combustor including a plurality of premixers and is operable with a fuel/air mixture equivalence ratio less than one. The water delivery system supplies at least one of water or steam to the gas turbine engine such that water or steam is injected into the combustor.

During normal gas turbine engine operations, fuel is supplied proportionally with airflow to the combustor such that the combustor operates with a fuel/air mixture equivalence ratio less than one. As gas turbine engine operating speeds increase and additional fuel and air are supplied to the combustor, the water delivery sub-system supplies either water or steam to the combustor. The increase in combustion zone flame temperatures generated as a result of additional fuel being burned within the combustor is minimized with the water or steam supplied to the combustor. As a result, nitrous oxide emissions generated are reduced. Alternatively, the gas turbine engine may achieve an increased operating power level for a specified nitrous oxide emission level.

DETAILED DESCRIPTION OF THE INVENTION

Figure 1:
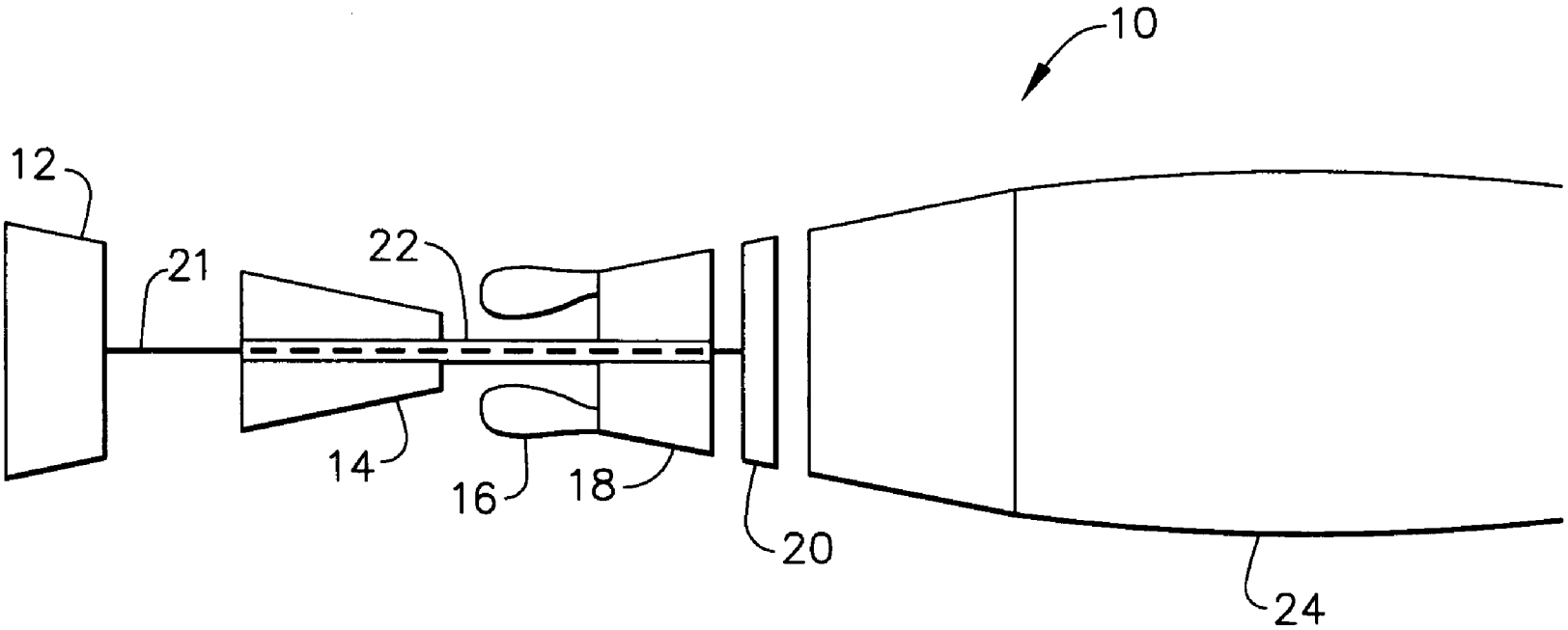
FIG. 1 is a schematic illustration of a gas turbine engine.

FIG. 1 is a schematic illustration of a gas turbine engine 10 including a low pressure compressor 12, a high pressure compressor 14, and a combustor 16. Engine 10 also includes a high pressure turbine 18 and a low pressure turbine 20. Combustor 16 is a lean premix combustor. Compressor 12 and turbine 20 are coupled by a first shaft 21, and compressor 14 and turbine 18 are coupled by a second shaft 22. A load (not shown) is also coupled to gas turbine engine 10 with first shaft 21. In one embodiment, gas turbine engine 10 is an LM6000 available from General Electric Aircraft Engines, Cincinnati, Ohio. Alternatively, gas turbine engine 10 is an LM 2500 available from General Electric Aircraft Engines, Cincinnati, Ohio.

In operation, air flows through low pressure compressor 12 and compressed air is supplied from low pressure compressor 12 to high pressure compressor 14. The highly compressed air is delivered to combustor 16. Airflow from combustor 16 drives turbines 18 and 20 and exits gas turbine engine 10 through a nozzle 24.

Figure 2:
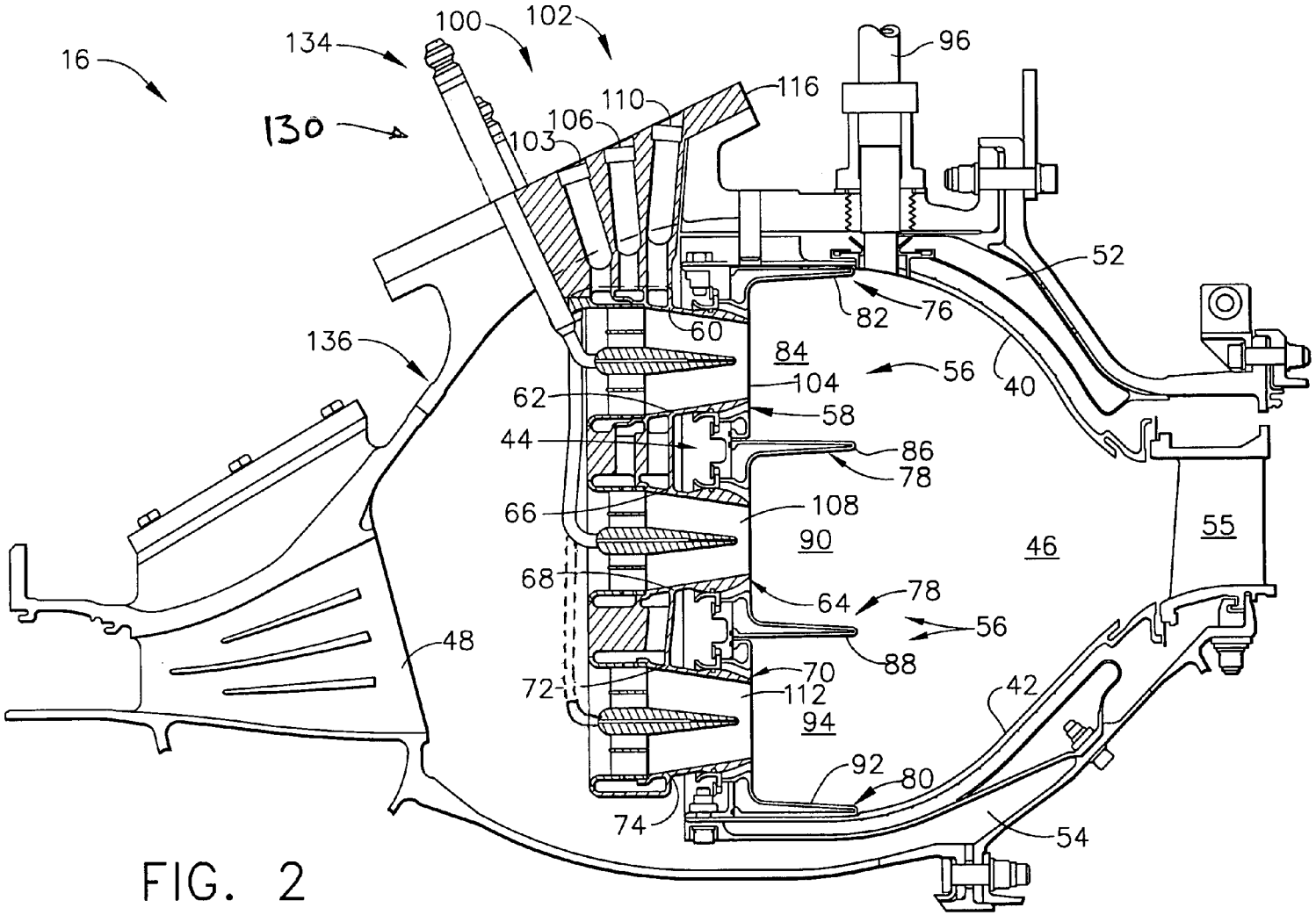
FIG. 2 is a cross-sectional view of a combustor used with the gas turbine engine shown in FIG. 1.

FIG. 2 is a cross-sectional view of combustor 16 used in gas turbine engine 10 (shown in FIG. 1). Because combustor 16 is a lean premix combustor, a fuel/air mixture supplied to combustor 16 contains more air than is required to fully combust the fuel. Accordingly, a fuel/air mixture equivalence ratio for combustor 16 is less than one. Because combustor 16 premixes fuel with air, combustor 16 is a lean premix combustor. Combustor 16 includes an annular outer liner 40, an annular inner liner 42, and a domed end 44 extending between outer and inner liners 40 and 42, respectively. Outer liner 40 and inner liner 42 are spaced radially inward from a combustor casing 136 and define a combustion chamber 46. Combustor casing 136 is generally annular and extends downstream from a diffuser 48. Combustion chamber 46 is generally annular in shape and is disposed radially inward from liners 40 and 42. Outer liner 40 and combustor casing 136 define an outer passageway 52 and inner liner 42 and combustor casing 136 define an inner passageway 54. Outer and inner liners 40 and 42 extend to a turbine nozzle 55 disposed downstream from diffuser 48.

Combustor domed end 44 includes a plurality of domes 56 arranged in a triple annular configuration. Alternatively, combustor domed end 44 includes a double annular configuration. In another embodiment, combustor domed end 44 includes a single annular configuration. An outer dome 58 includes an outer end 60 fixedly attached to combustor outer liner 40 and an inner end 62 fixedly attached to a middle dome 64. Middle dome 64 includes an outer end 66 attached to outer dome inner end 62 and an inner end 68 attached to an inner dome 70. Accordingly, middle dome 64 is between outer and inner domes 58 and 70, respectively. Inner dome 70 includes an inner end 72 attached to middle dome inner end 68 and an outer end 74 fixedly attached to combustor inner liner 42.

Combustor domed end 44 also includes a outer dome heat shield 76, a middle dome heat shield 78, and an inner dome heat shield 80 to insulate each respective dome 58, 64, and 70 from flames burning in combustion chamber 46. Outer dome heat shield 76 includes an annular endbody 82 to insulate combustor outer liner 40 from flames burning in an outer primary combustion zone 84. Middle dome heat shield 78 includes annular centerbodies 86 and 88 to segregate middle dome 64 from outer and inner domes 58 and 70, respectively. Middle dome centerbodies 86 and 88 are disposed radially outward from a middle primary combustion zone 90. Inner dome heat shield 80 includes an annular endbody 92 to insulate combustor inner liner 42 from flames burning in an inner primary combustion zone 94. An igniter 96 extends through combustor casing 136 and is disposed downstream from outer dome heat shield endbody 82.

Domes 58, 64, and 70 are supplied fuel and air via a premixer and assembly manifold system (not shown). A plurality of fuel tubes 102 extend between a fuel source (not shown) and plurality of domes 56. Specifically, an outer dome fuel tube 103 supplies fuel to a premixer cup 104 disposed within outer dome 58, a middle dome fuel tube 106 supplies fuel to a premixer cup 108 disposed within middle dome 64, and an inner dome fuel tube 110 supplies fuel to a premixer cup 112 disposed within inner dome 70.

Combustor 16 also includes a water delivery system 130 to supply water to gas turbine engine 10 such that water is injected into combustor 16. Water delivery system 130 includes a plurality of water injection nozzles 134 connected to a water source (not shown). Water injection nozzles 134 are in flow communication with premixer cups 104, 108, and 112 and inject an atomized water spray into the fuel/air mixture created in premixer cups 104, 108, and 112. In an alternative embodiment, injection nozzles 134 are connected to a steam source (not shown) and steam is injected into the fuel/air mixture using nozzles 134.

During operation of gas turbine engine 10, air and fuel are mixed in premixer cups 104, 108, and 112 and the fuel/air mixture is directed into domes 58, 64, and 70, respectively. The mixture burns in primary combustion zones 84, 90, and 94 of domes 58, 64, and 70 that are active. At high power gas turbine engine operations, fuel entering premixer cup 108 is increased, resulting in a higher fuel/air ratio within dome 64.

Middle dome 64 is known as a pilot-dome and has fuel supplied thereto during all phases of operation of engine 10. Domes 58 and 70 have fuel supplied thereto as demanded by operating power requirements of gas turbine engine 10. As gas turbine engine operating power requirements are increased, water is also supplied to domes 58, 64, and 70, as demanded to meet nitrous oxide emission requirements. Gas turbine engine 10 has a rated engine operating capacity. To operate gas turbine engine 10 above 90% rated engine operating capacity, additional fuel is supplied only to combustor middle dome 64. During such engine power operations, water delivery system 130 supplies additional water to middle dome 64 to minimize temperature increases as a result of additional fuel being burned within combustor middle dome 64.

More specifically, when gas turbine engine 10 is operated above approximately 90% rated engine power capacity, additional fuel is supplied only to combustor middle dome 64 because outer and inner dome flame temperatures are limited by dynamic pressure or acoustic boundaries. When gas turbine engine 10 is operating at such a capacity, water delivery system 130 supplies water to combustor 16 to maintain flame temperatures generated within middle dome 64 approximately equal to flame temperatures generated within outer and inner domes 58 and 70. Furthermore, nitrous oxide emissions generated within middle dome 64 are maintained at a level approximately equal to those levels generated within outer and inner domes 58 and 70. Additionally, by supplying additional water to only middle dome 64 during such engine operations, the potential adverse effects of generating additional carbon monoxide emissions within combustor 16 are offset by the reduction in nitrous oxide emissions and the increase in operating capacity. Alternatively, the operating power level of gas turbine engine 10 may be increased for a specified nitrous oxide emission level.

Similarly, as engine performance degrades over time, additional fuel is required to produce similar engine output in comparison to engines that have not deteriorated. For the reasons discussed above, additional fuel is supplied to combustor middle dome 64. During such engine operations, water delivery system 130 supplies water at an increased flow rate to middle dome 64 to maintain the middle dome flame temperatures and to control the generation of emissions resulting from increased fuel flow.

In a further embodiment, water delivery system 130 is selectively operable between a first mode of operation and a second mode of operation. The first operating mode of water delivery system 130 is activated during all phases of operation of gas turbine engine 10 above engine idle operations. Typically, in the first operation mode, water delivery system 130 supplies water proportionally to all three domes 58, 64, and 70 at approximately the same rate.

The second operating mode of water delivery system 130 is activated when gas turbine engine 10 is operated above 90% rated engine operating capacity. When water delivery system 130 operates in the second operating mode, water is supplied to middle dome 64 at a higher flow rate than water supplied to dome 64 when water delivery system 130 is in the first operating mode. The increased rate of water supplied during the second operating mode reduces nitrous oxide emissions from gas turbine engine 10.

In an alternative embodiment, when gas turbine engine 10 is operated above 90% rated engine operating capacity, steam is added to the fuel upstream from combustor 16. In a further embodiment, steam is added to the fuel upstream from combustor 16 when the gas turbine engine is operated above idle power operations. The steam/fuel mixture is supplied only to combustor middle dome 64 because outer and inner dome flame temperatures are limited by dynamic pressure or acoustic boundaries. The steam/fuel mixture is heated prior to being introduced to middle dome 64 to prevent condensation from forming and is mixed thoroughly prior to be injected into combustor middle dome 64. Additional steam permits flame temperatures generated within middle dome 64 to be maintained approximately equal that of flame temperatures generated within outer and inner domes 58 and 70. As a result, nitrous oxide emissions generated within middle dome 64 are maintained at a level approximately equal to those levels generated within outer and inner domes 58 and 70. Furthermore, because additional steam is supplied only to middle dome 64, the potential adverse effects of additional carbon monoxide emissions generated within combustor 16 are offset by the reduction in nitrous oxide emissions and the increase in engine operating capacity.

The above-described combustor system for a gas turbine engine is cost-effective and reliable. The combustor system includes a combustor operable with a fuel/air mixture equivalence ratio less than one and a water delivery system that injects water and/or steam into the combustor to reduce nitrous oxide emissions generated during gas turbine engine operations. As a result, nitrous oxide emissions for specified turbine operating power levels are lowered. Alternatively, the operating power level of the gas turbine engine may be increased for a specified nitrous oxide emission level.

While the invention has been described in terms of various specific embodiments, those skilled in the art will recognize that the invention can be practiced with modification within the spirit and scope of the claims.

What is claimed is:

1. A method for operating a gas turbine combustor of a gas turbine engine using a water delivery system, the combustor including a plurality of domes, the water delivery system connected to the gas turbine engine, said method comprising the steps of:

supplying at least one combustor dome with a fuel/air mixture equivalence ratio less than one; and separately supplying at least one of water and steam into the gas turbine engine with the water delivery system such that at least one of atomized water and steam is separately injected into the combustor through an orifice in a fuel/air premixer centerbody such that the fuel/air mixture and the at least one of atomized water and steam are only mixed downstream from the centerbody wherein the orifice extends through the centerbody substantially coincident with a longitudinal axis of the centerbody.

2. A method in accordance with claim 1 wherein said step of supplying at least one of water and steam further comprising the step of supplying at least one of water and steam to at least one of the plurality of domes.

3. A method in accordance with claim 1 wherein the combustor includes a first dome, a second dome, and a third dome, the second dome disposed radially inward from the first dome and the third dome, said step of supplying at least one of water and steam further comprises the step of supplying at least one of water and steam to the combustor second dome.

4. A method in accordance with claim 1 wherein the combustor includes at least one dual fuel nozzle, said step of supplying at least one of water and steam further comprises the step of supplying at least one of water and steam to the combustor through at least one dual fuel nozzle.

5. A method in accordance with claim 1 wherein the gas turbine engine has a rated engine operating capability, said step of supplying at least one of water and steam further comprises the step of supplying at least one of water and steam to the gas turbine engine when the engine is operating at an operating speed greater than approximately 90 percent rated engine power capability.

6. A combustor system for a gas turbine engine, said combustor system comprising: a combustor comprising a plurality of domes, at least one of said combustor domes configured to operate with a fuel/air mixture equivalence ratio less than one; and a water delivery sub-system connected to the gas turbine engine and configured to separately supply at least one of water and steam to the gas turbine such that at least one of atomized water and steam is separately injected into the combustor through an orifice in a fuel/air premixer centerbody such that the fuel/air mixture and the at least one of atomized water and steam are only mixed downstream from the centerbody wherein the orifice extends through the centerbody substantially coincident with a longitudinal axis of the centerbody.

7. A combustor system in accordance with claim 6 wherein said water delivery sub-system further configured to supply at least one of water and steam to at least one dome of said combustor.

8. A combustor system in accordance with claim 7 wherein said combustor further comprises at least one dual fuel nozzle, said water delivery sub-system further configured to supply at least one of water and steam to said combustor through at least one dual fuel nozzle.

9. A combustor system in accordance with claim 7 wherein said combustor further comprises at least one premixer in flow communication with said water delivery sub-system.

10. A combustor system in accordance with claim 6 wherein said combustor comprises a first dome, a second dome, and a third dome, said second dome disposed between said first and third domes, said water delivery sub-system further configured to supply at least one of water and steam to said combustor second dome.

11. A combustor system in accordance with claim 6 wherein said water delivery sub-system selectively operable in a first mode and a second mode, said water delivery sub-system further configured to supply water to said combustor at a first flow rate when in the first operating mode, said water delivery sub-system further configured to supply water to said combustor at a higher flow rate when in the second operating mode.

12. A combustor system in accordance with claim 11 wherein the engine has a rated engine power, said water delivery sub-system is further configured to supply water in the first operating mode when the gas turbine engine operates below a predefined percentage of the rated engine power and supply water in the second operating mode when the gas turbine engine operates above the predefined percentage of the rated engine power.

13. A gas turbine engine comprising a combustor system comprising a combustor and a water delivery sub-system, said combustor being a lean premix combustor comprising a plurality of domes, at least one of said domes configured to operate with a fuel/air mixture equivalence ratio less than one, said water delivery sub-system configured to separately supply at least one of water and steam to the gas turbine engine such that at least one of atomized water and steam is separately injected into the combustor through an orifice in a fuel/air premixer centerbody such that the fuel/air mixture and the at least one of atomized water and steam are only mixed downstream from the centerbody wherein the orifice extends through the centerbody substantially coincident with a longitudinal axis of the centerbody.

14. A gas turbine engine in accordance with claim 13 wherein said combustor comprises at least one premixer, said water delivery sub-system further configured to supply at least one of water and steam to at least one premixer of said combustor.

15. A gas turbine engine in accordance with claim 13 wherein said water delivery sub-system further configured to supply at least one of water and steam to at least one dome of said combustor.

16. A gas turbine engine in accordance with claim 15 wherein said combustor further comprises a first dome, a second dome, and a third dome, said second dome disposed between said first and third domes, said water delivery sub-system further configured to supply at least one of water and steam to said combustor second dome.

17. A gas turbine engine in accordance with claim 13 wherein said water delivery sub-system selectively operable in a first mode and a second mode, said water delivery sub-system further configured to supply water to said combustor at a first flow rate when in the first operating mode, said water delivery sub-system further configured to supply water to said combustor at a higher flow rate when in the second operating mode.

18. A gas turbine engine in accordance with claim 17 wherein said gas turbine engine has a rated engine power capability, said water delivery sub-system further configured to supply water in the first operating mode when the gas turbine engine operates below a predefined percentage of the rated engine power and supply water in the second operating mode when the gas turbine engine operates above the predefined percentage of the rated engine power.

19. A gas turbine engine in accordance 18 wherein said water delivery sub-system further configured to supply water in the second operating mode when said gas turbine engine is operating at an operating speed greater than approximately 90 percent rated engine power capability.

* * * * *